US005165382A

United States Patent [19]

Morrison

[11] Patent Number: 5,165,382

[45] Date of Patent: Nov. 24, 1992

[54] POWER-VARIABLE BOW

[75] Inventor: David E. Morrison, Palm Harbor, Fla.

[73] Assignee: Saxon International, Inc., Tarpon Springs, Fla.

[21] Appl. No.: 651,742

[22] Filed: Feb. 7, 1991

[51] Int. Cl.[5] ..... F41B 5/00

[52] U.S. Cl. ..... 124/23.1; 124/25.6; 124/88

[58] Field of Search ..... 124/23.1, 25.6, 88, 124/86, 24.1

[56] References Cited

U.S. PATENT DOCUMENTS

| | | | |
|---|---|---|---|
| 261,610 | 7/1882 | Howe | 124/23.1 |
| 2,966,903 | 1/1961 | Veneko | 124/23.1 |
| 3,583,380 | 6/1971 | Karbo | 124/23.1 |
| 3,674,001 | 7/1972 | Hitt | 124/23.1 |
| 3,757,762 | 9/1973 | Cousin | 124/23.1 |
| 3,921,598 | 11/1975 | Helmick | 124/23.1 |
| 4,018,205 | 4/1977 | Meyer | 124/23.1 |
| 4,644,928 | 2/1987 | Studanski | 124/88 X |
| 4,671,249 | 6/1987 | Troncoso | 124/25.6 |
| 4,724,820 | 2/1988 | Chattin | 124/25.6 |

*Primary Examiner*—Peter M. Cuomo

*Attorney, Agent, or Firm*—Basile and Hanlon

[57] ABSTRACT

A power-variable bow has a bow string and a single piece resilient bow limb having a width and a first and second outer end. A member has a nock end, with the member being removably attached to each of the bow limb first and second outer ends. The power-variable bow may further comprise a section, removably attachable to the bow limb, for increasing the amount of power imparted to an arrow by the bow. In a further embodiment of the bow, in place of the nock end member is a terminal end attached to each of the bow limb first and second outer ends, the terminal end having bow stringing cable grooves and bow string grooves. This embodiment may further be converted into a power-variable compound bow.

14 Claims, 2 Drawing Sheets

POWER-VARIABLE BOW

BACKGROUND OF THE INVENTION

1. Field of the Invention

The present invention relates generally to hunting bows, and more particularly to a single bow whose power can be increased through the use of a rear booster section.

2. Description of the Relevant Art

Given the fact that different archers have different physiques, some adaptation of the archer to the particular bow is normally required. The optimum full-draw position of the bow involves the gripping of the bow with one hand and the drawing back of the string with the other until the string touches the archer's cheekbone below his sighting eye. The arm holding the bow is thus extended to establish the draw length at the correct distance forwardly from the fixed reference point constituted by the archer's cheekbone. Where the grip is in a permanently fixed relationship to the bow limbs, as described above, archers with different draw lengths are required to select a specific bow to accommodate the individual archer's draw.

As can be expected, bow manufacturers must produce many different bows of various lengths and having varied capabilities as to how much power the bow imparts to an arrow. In addition, most conventional bows are assembled from two bow limbs, each being the same length. Due to the above factors, the manufacture of bows is a very time consuming and expensive process which also leads to inefficient manufacturing processes, due to the fact that individual parts are made and sized to fit only certain configurations of bows.

Therefore, it would be desirable to provide a bow which would be quick and easy to manufacture and assemble, while having the ability to vary the power of the bow and also the ability to easily change the type of bow, with only minor modifications.

SUMMARY OF THE INVENTION

The present invention addresses and solves all the problems enumerated above. The present invention comprises a power-variable bow having a bow string. A single piece resilient bow limb has a width and a first and second outer end. A member has a nock end, with the member being removably attached to each of the bow limb first and second outer ends. The power-variable bow may further comprise means, removably attachable to the bow limb, for increasing the amount of power imparted to an arrow by the bow. In a further embodiment of the bow, in place of the nock end member is a terminal end attached to each of the bow limb first and second outer ends, the terminal end having bow stringing cable grooves and bow string grooves. This embodiment may further comprise means for converting the power-variable bow into a power-variable compound bow.

BRIEF DESCRIPTION OF THE DRAWINGS

Other objects and features of the present invention will become apparent by reference to the following detailed description and drawings, in which.

DESCRIPTION OF THE PREFERRED EMBODIMENTS

Figures 1, 4, 9:
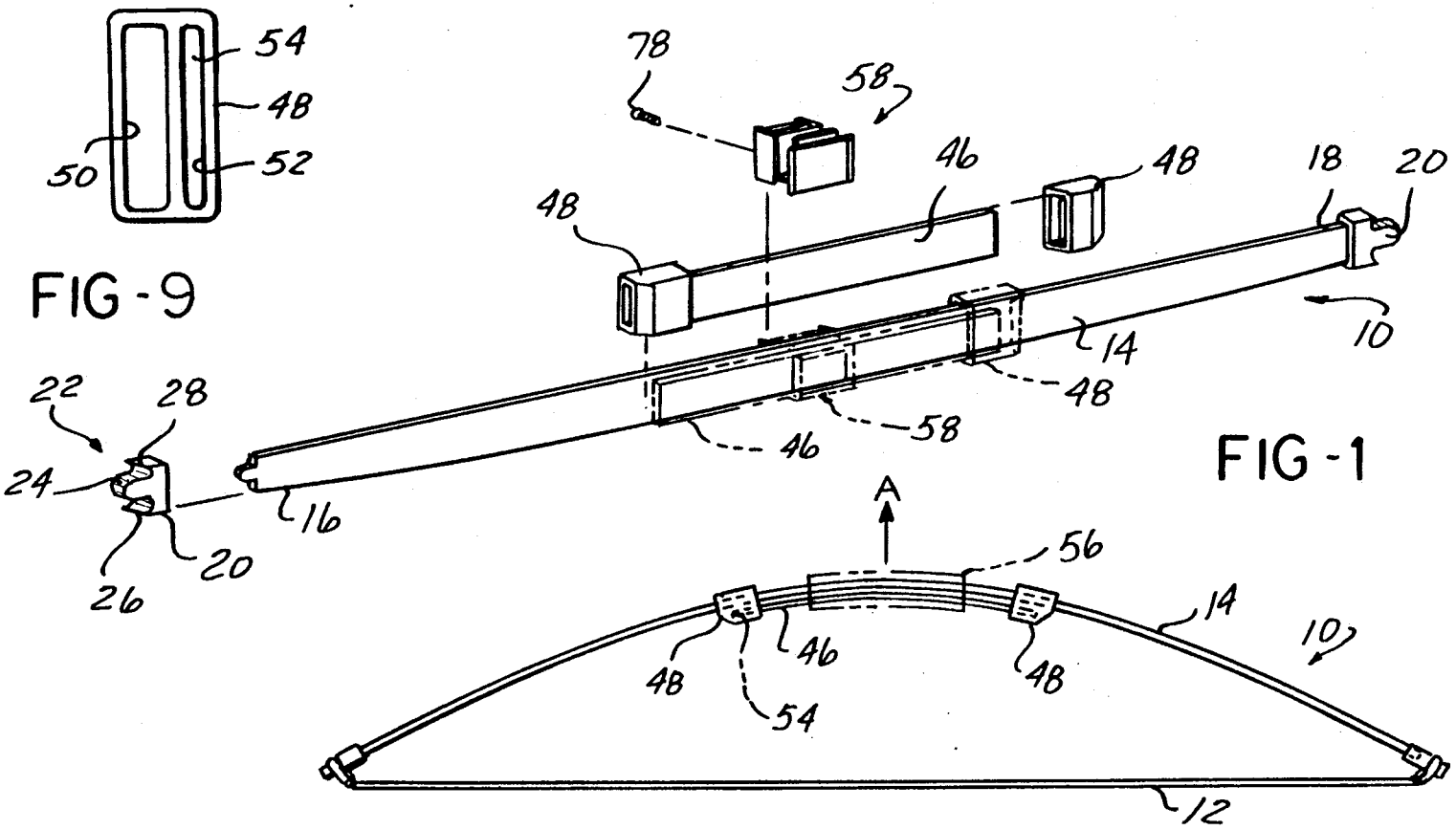
FIG. 1 is an exploded perspective view of the first embodiment of the present invention showing the resilient bar and attaching member, as well as the center assembly.
FIG. 4 is a side view of the first embodiment, showing an archery handle in phantom and a bow string attached to the bow limb.
FIG. 9 is an end view of the attaching member.

The power-variable prod or bow of the present invention, which is useful for all types of bows, including hand held archery bows, compound bows and any type of cross bow, including pistol cross bows, is designated generally as 10. Referring now to FIGS. 1 and 4, the power-variable bow 10 has a bow string 12 and a single piece resilient bow limb 14 having a width and a first and second outer end 16, 18 respectively. A member 20 has a nock end 22, with the member being attached to each of the bow limb first and second outer ends, 16, 18 respectively. Nock end member 20 may be permanently or removably attached to bow limb 14, as desired. Nock end member 20 may be formed of any suitable material and of any suitable shape, but in the preferred embodiment, this member 20 is integrally molded from a suitably rigid polymeric material, with member 20 having a center protrusion 24 and two smaller protrusions 26, 28, one on each side of center protrusion 24, center protrusion 24 being adapted to retain bow string 12, as seen in FIG. 4, and each smaller protrusion 26, 28 adapted to prevent bow string 12 from lateral sliding movement. The direction of arrow flight is shown by arrow A in FIG. 4. It is to be understood that FIGS. 1–3 also would have this flight direction for an arrow shot.

Figure 5:
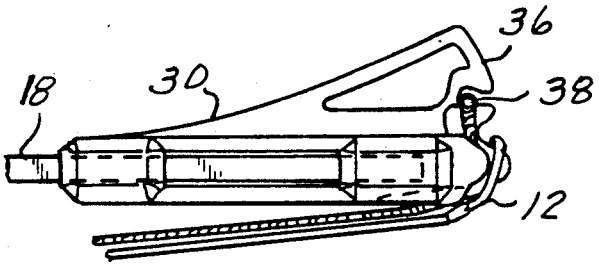
FIG. 5 is an enlarged side view of the terminal end of the second embodiment of the present invention, showing the attachment of the bow stringing cable and the bow string.
Figure 6:
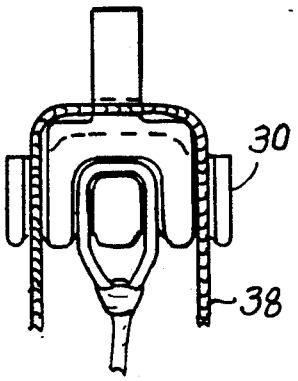
FIG. 6 is an end view of the view shown in FIG. 5.
Figure 7:
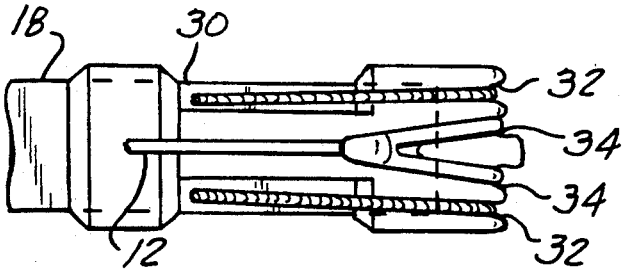
FIG. 7 is a bottom view of the view shown in FIG. 5.

Referring now to FIGS. 5–8, in the second embodiment of power-variable bow 10, instead of nock end member 20, a terminal end 30 is attached to each of the bow limb first and second ends 16, 18 respectively, with terminal end 30 having bow stringing cable grooves 32 and bow string grooves 34, as best seen in FIG. 7. Terminal end 30 may be fixedly or removably attached, as desired. Terminal end 30 may further be formed of any suitable material and in any suitable shape, but in the preferred embodiment, as best seen in FIG. 5, terminal end 30 is formed to resemble the end of a conventional recurve bow. In addition, optional upper member 36 biases against bow stringing cable 38 to help hold it in bow stringing cable groove 32 as long as desired.

Figure 8:
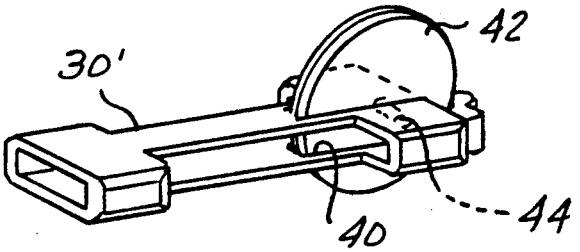
FIG. 8 is a variation of the terminal end shown in FIG. 5, showing the pulley receiving groove and pulley integrally and rotatably mounted within the terminal end.

The second embodiment of the present invention may be varied in the following manner. Terminal end 30', as seen in FIG. 8, may include means for converting power-variable bow 10 intó a power-variable compound bow. This converting means may comprise any suitable means, such as any manipulations known in the tool and die industry. In the preferred embodiment, a pulley receiving groove 40 is integrally formed in terminal end 30′ prime. A pulley 42 is disposed within groove 40, and means 44 are provided for rotatably mounting pulley 42 within pulley receiving groove 40.

Pulley 42 is of conventional design and arrangement, about which cable 38 and bowstring 12 are operatively trained, in a conventional manner well known in the art.

Figure 2:
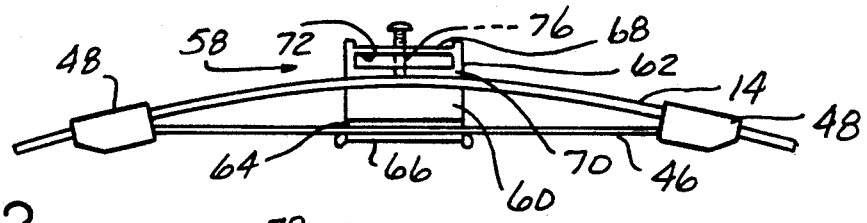
FIG. 2 is an enlarged cut away side view of the embodiment shown in FIG. 1, showing the resilient bar in the fully spaced position.
Figure 3:
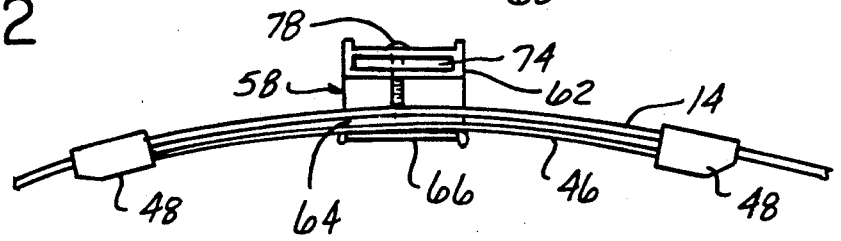
FIG. 3 is a view similar to FIG. 2, showing the resilient bar in the closest spaced position.

In either of the first and second embodiments, the power-variable bow 10 may further comprise means, removably attachable to the bow limb 14, for increasing the amount of power imparted to an arrow (not shown) by bow 10. This power increasing means may comprise any suitable means, but in the preferred embodiment, the power increasing means comprises a resilient bar 46 having a predetermined length, stiffness and thickness, and a width not greater than the bow limb width, as best seen in FIGS. 1-3. Also provided are means for spacedly attaching resilient bar 46 to bow limb 14. Without being bound to any one theory, it is believed that this power increasing means or rear booster section works in the following manner. As the length of bow limb 14 increases, the flexibility of bow 10 increases. It follows that the more flexible bow 10 is, the less power is imparted to an arrow by bow 10. Similarly, the stiffer bow limb 14 is, the more power imparted by bow 10. By adding the power increasing means at a point of the bow limb 14 most likely to bend, i.e. close to the midpoint, the extra stiffness will make bow limb 14 harder to bend, thereby increasing the power of bow 10. Therefore, by choosing the length, stiffness and thickness of resilient bar 46 as desired, and spacedly attaching it to bow limb 14, one may add a predetermined amount of power to an already existing bow 10.

The means for spacedly attaching resilient bar 46 to the bow limb may comprise any suitable means, but in the preferred embodiment, this attaching means comprises an attaching member 48 slidingly engageable with bow limb 14 and with resilient bar 46, attaching member 48 having a bore 50 therethrough, bore 50 being sized so as to closely conform to bow limb 14. Attaching member 48 further has a slot 52 open at one end and closed at an opposite end, slot 52 receiving one end of resilient bar 46 through the open end of slot 52. As best seen in FIG. 9, slot 52 has a back wall 54 against which one end of resilient bar 46 abuts, as also seen in FIG. 4.

In both the first and second embodiments, an archery riser or handle 56 may be removably or fixedly secured on bow limb 14 at a point approximately midway between the first and second outer ends 16, 18 as seen in FIG. 4.

Referring now to FIGS. 2 and 3, also in both the first and second embodiments, power-variable bow 10 may further comprise means for varying the amount of the power increase imparted by the power increasing means. This varying means may comprise any suitable means, but in the preferred embodiment, the varying means comprises a center assembly 58 having a back wall 60 and spaced first, second and third legs 62, 64 and 66 respectively, with the first, second and third legs 62, 64 and 66 extending outwardly from back wall 60. Bow limb 14 is disposed between the first and second legs and abuts back wall 60, with resilient bar 46 being disposed between the second and third legs and abutting back wall 60. First leg 62 has upper and lower walls 68 and 70 respectively and a slot 72 therebetween, slot 72 being open at one end and closed at an opposite end. A plate 74 is disposed in slot 72. A threaded bore 76 extends through first leg upper wall 68, plate 74 and first leg lower wall 70, respectively, and a tension or nose screw 78 threadingly extends through threaded bore 76 and engages bow limb 14 at one end of screw 78. Tension screw 78 is selectively adjustable with respect to bow limb 14 so as to vary the spacing between the bow limb 14 and resilient bar 46. In order to prevent tension screw 78 from slipping, an optional dimple or notch (not shown) may be provided in a corresponding spot on bow limb 14.

Again, without being bound to any theory, it is believed that this varying means works in the following way. When tension screw 78 is in its outermost position, resilient bar 46 is in its furthest position spaced away from bow limb 14 as seen in FIG. 2. In this position, the minimum amount of extra thickness is added to bow limb 14, thereby increasing the power of bow 10 a minimum amount. As shown in FIG. 3, when tension screw is in its fully extended position, resilient bar 46 is drawn as close as possible to bow limb 14, thereby adding the maximum amount of thickness and power to bow 10. As can be expected, there are a plurality of spaced positions in between those shown in FIGS. 2 and 3. Again, it is to be understood that this is merely an example of many possible varying means. Also, in the embodiment described above, bore 76 may extend through any or all of the resilient bar 46, bow limb 14, second and third legs 64, 66. The tension or nose screw 78 may then be threadingly engaged in bore 76, however far it is made to extend. If screw 78 extends through third leg 66, a nut (not shown) may be attached, or any suitable means engaged on the other end of the screw 78.

Among the many advantages of both embodiments of the present invention are the following. The bow limb is comprised of one continuous flat bar instead of two bow limb halves. This bar may be made of any suitable material, including fiberglass. Since all the components such as the nock end, terminal end, attaching member, resilient bar, etc. are all removable, one single piece bow limb may be changed into several different kinds of bows with various powers by simply interchanging the components on one bow limb. This versatility cuts down on manufacturing time and costs, especially if the removable components are made to be interchangeable with several different sized bow limbs.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A power-variable bow having a bowstring, comprising:

a single-piece resilient bow limb having a width and a first and second outer end;

a member having a nock end, the member being attached to each of the bow limb first and second outer ends; and means, removably attachable to the bow limb, for increasing the amount of power imparted to an arrow by the bow, wherein the power increasing means comprises:

a resilient bar having a predetermined length, stiffness and thickness, and a width not greater than the bow limb width; and means for spacedly attaching the resilient bar to the bow limb, wherein the attaching means comprises an attaching member slidingly engageable with the bow limb and with the resilient bar, the attaching member having a bore therethrough, the bore being sized so as to closely conform to the bow limb, the attaching member further having a slot open at one end and closed at an opposite end, the slot receiving one end of the resilient bar through the open end of the slot.

2. The power-variable bow as defined in claim 1 wherein the nock end member is removable.

3. The power-variable bow as defined in claim 1 wherein the nock end member is integrally molded from a polymeric material, and wherein the member has a center protrusion and two smaller protrusions, one on each side of the center protrusion, the center protrusion adapted to retain the bowstring, and each smaller protrusion adapted to prevent the bowstring from lateral sliding movement.

4. The power-variable bow as defined in claim 1, further comprising an archery riser secured on the bow limb at a point approximately midway between the first and second outer ends.

5. The power-variable bow as defined in claim 1, further comprising:

means for varying the amount of the power increase imparted by the power increasing means.

6. A power-variable bow having a bowstring, comprising:

a single-piece resilient bow limb having a width and a first and second outer end;

a member having a nock end, the member being attached to each of the bow limb first and second outer ends;

means, removably attachable to the bow limb, for increasing the amount of power imparted to an arrow by the bow, wherein the power increasing means comprises:

a resilient bar having a predetermined length, stiffness and thickness, and a width not greater than the bow limb width; and means for spacedly attaching the resilient bar to the bow limb; and means for varying the amount of the power increase imparted by the power increasing means, wherein the varying means comprises:

a center assembly having a back wall and spaced first, second and third legs, the first, second and third legs extending outwardly from the back wall, the bow limb being disposed between the first and second legs and abutting the back wall, the resilient bar being disposed between the second and third legs and abutting the back wall, the first leg having upper and lower walls and a slot therebetween, the slot being open at one end and closed at an opposite end;

a plate disposed in the first leg slot;

a threaded bore extending through the first leg upper wall, the plate and the first leg lower wall, respectively; and a tension screw threadingly extending through the threaded bore and engaging the limb at one end of the screw, the tension screw selectively adjustable with respect to the bow limb so as to vary the spacing between the bow limb and the resilient bar.

7. A power-variable bow having a bowstring, comprising:

a single-piece resilient bow limb having a width and a first and second outer end;

a member having a nock end, the nock end member being removably attached to each of the bow limb first and second outer ends;

means, removably attachable to the bow limb, for increasing the amount of power imparted to an arrow by the bow, the power increasing means comprising:

a resilient bar having a predetermined length, stiffness and thickness, and a width not greater than the bow limb width; and a member for spacedly attaching the resilient bar to the bow limb, the attaching member being slidingly engageable with the bow limb and with the resilient bar, the attaching member having a bore therethrough, the bore being sized so as to closely conform to the bow limb, the attaching member further having a slot open at one end and closed at an opposite end, the slot receiving one end of the resilient bar through the open end of the slot; and means for varying the amount of the power increase imparted by the power increasing means.

8. A power-variable bow having a bowstring, comprising:

a single piece resilient bow limb having a width and a first and second outer end;

a terminal end attached to each of the bow limb first and second outer ends, the terminal end having bow-stringing cable grooves and bowstring grooves; and means, removably attachable to the bow limb, for increasing the amount of power imparted to an arrow by the bow, wherein the power increasing means comprises:

a resilient bar having a predetermined length, stiffness and thickness, and a width not greater than the bow limb width; and means for spacedly attaching the resilient bar to the bow limb, wherein the attaching means comprises an attaching member slidingly engageable with the bow limb and with the resilient bar, the attaching member having a bore therethrough, the bore being sized so as to closely conform to the bow limb, the attaching member further having a slot at one end and closed at an opposite end, the slot receiving one end of the resilient bar through the open end of the slot.

9. The power-variable bow as defined in claim 8 wherein the terminal end is removable.

10. The power-variable bow as defined in claim 8 wherein the terminal end and further comprises:

means for converting the power-variable bow into a power-variable compound bow, the converting means comprising:

a pulley receiving groove integrally formed in the terminal end;

a pulley; and means for rotatably mounting the pulley within the pulley receiving groove.

11. The power-variable bow as defined in claim 8, further comprising an archery riser secured on the bow limb at a point approximately midway between the first and second outer ends.

12. The power-variable bow as defined in claim 8, further comprising:

means for varying the amount of the power increase imparted by the power increasing means.

13. A power-variable bow having a bowstring, comprising:

a single-piece resilient bow limb having a width and a first and second outer end;

a terminal end attached to each of the bow limb first and second outer ends, the terminal end having bow-stringing cable grooves and bowstring grooves;

means, removably attachable to the bow limb, for increasing the amount of power imparted to an arrow by the bow, wherein the power increasing means comprises:

a resilient bar having a predetermined length, stiffness and thickness, and a width not greater than the bow limb width; and means for spacedly attaching the resilient bar to the bow limb; and means for varying the amount of the power increase imparted by the power increasing means, wherein the varying means comprises:

a center assembly having a back wall and spaced first, second and third legs, the first, second and third legs extending outwardly from the back wall, the bow limb being disposed between the first and second legs and abutting the back wall, the resilient bar being disposed between the second and third legs and abutting the back wall, the first leg having upper and lower walls and a slot therebetween, the slot being open at one end and closed at an opposite end;

a plate disposed in the first leg slot;

a threaded bore extending through the first leg upper wall, the plate and the first leg lower wall, respectively; and a tension screw threadingly extending through the threaded bore and engaging the limb at one end of the screw, the tension screw selectively adjustable with respect to the bow limb so as to vary the spacing between the bow limb and the resilient bar.

14. A power-variable bow having a bowstring, comprising:

a single-piece resilient bow limb having a width and a first and second outer end;

a terminal end removably attached to each of the bow limb first and second outer ends, the terminal end having a bow-stringing cable groove and a bowstring groove;

means, removably attachable to the bow limb, for increasing the amount of power imparted to an arrow by the bow, the power increasing means comprising:

a resilient bar having a predetermined length, stiffness and thickness, and a width not greater than the bow limb width; and a member for spacedly attaching the resilient bar to the bow limb, the attaching member being slidingly engageable with the bow limb and with the resilient bar, the attaching member having a bore therethrough, the bore being sized so as to closely conform to the bow limb, the attaching member further having a slot open at one end and closed at an opposite end, the slot receiving one end of the resilient bar through the open end of the slot; and means for varying the amount of the power increase imparted by the power increasing means.

* * * * *